United States Patent [19]

Dickson

[11] 4,021,190

[45] May 3, 1977

[54] BURNER BLOCK VALVE ASSEMBLY

[75] Inventor: Fred D. Dickson, Sulphur Springs, Tex.

[73] Assignee: Rockwell International Corporation, Pittsburgh, Pa.

[22] Filed: Aug. 20, 1975

[21] Appl. No.: 606,047

[52] U.S. Cl. ..... 431/280; 137/625.19; 137/625.47

[51] Int. Cl.[2] ..... F23Q 9/08

[58] Field of Search ..... 431/280; 137/625.19, 137/625.47, 625.32

[56] References Cited

UNITED STATES PATENTS

| | | | |
|---|---|---|---|
| 979,335 | 12/1910 | Reid | 431/280 |
| 2,054,588 | 9/1936 | Stephens | 431/280 |
| 3,098,506 | 7/1963 | Spragens | 137/625.47 |
| 3,693,347 | 9/1972 | Kydd et al. | 60/39.3 |

*Primary Examiner*—Carlton R. Croyle
*Assistant Examiner*—Thomas I. Ross

[57] ABSTRACT

A burner block valve assembly for supplying oil and steam selectively to a main burner or stand-by burner when the main burner is being repaired or replaced includes a valve plug rotatably disposed in the valve body and rotatable between a main burner ignition position, an intermediate joint burner ignition position and a stand-by burner ignition position wherein steam and oil are routed from supply lines to the burners through two levels of passages, the valve plug including a first chordal slot adapted to route oil to the first level from an oil supply line directly to the main burner in the main burner ignition position, jointly to the main burner and the stand-by burner in the joint burner ignition position, and directly to the stand-by burner in the stand-by burner ignition position, the valve plug further including a second chordal slot adapted to route steam to the second level from a steam supply line directly to the main burner in the main burner ignition position, jointly to steam supply to both burners in the joint burner ignition position and directly to the stand-by burner in the stand-by burner ignition position. The angular span of the second slot being greater than that of the first slot whereby steam is supplied to the respective burners in advance of the oil supply to assure proper atomization of the oil.

4 Claims, 7 Drawing Figures

BURNER BLOCK VALVE ASSEMBLY

BACKGROUND OF THE INVENTION

1. Field of the Invention

This invention relates to burner valve assemblies and, in particular, to a valve assembly for a single burner industrial boiler wherein a single valve assembly selectively supplies oil and steam to a main burner or to a stand-by burner when the main burner is being repaired or replaced.

2. Description of the Prior Art

In relatively small industrial boiler installations, usually only a single burner is in continuous operation. To ensure complete atomization of the fuel oil, steam is continuously supplied to the burner tip during ignition. The environment in which such burners operate causes the tips thereof to deteriorate and requires replacement on a frequent basis.

Whereas multiple burner boilers can handle replacement of a worn burner by merely retracting the latter while the other burners carry the load, a single burner industrial boiler requires a stand-by burner to carry the load. The stand-by burner is normally not located in the burner environment and is inserted therein only to carry the load while the main burner is being repaired. To accommodate the necessary insertion, lighting and withdrawing of the stand-by burner, a series of conventional shut-off valves are provided which must be operated in a particular sequence by the boiler attendant.

For instance, if the boiler is lit and the worn out tip is repaired or replaced, the attendant inserts the stand-by burner, opens the stand-by steam valve and then the stand-by oil valve so as to effect ignition of the stand-by burner. Then the main oil valve is closed and thereafter the main steam valve is closed. The main burner is then withdrawn for repair. To replace the main burner, a reverse procedure is followed.

SUMMARY OF THE INVENTION

The present invention provides a single valve assembly which selectively affirmatively ignites and extinguishes the stand-by and main burners in the proper sequence so as to allow proper sequencing of the assembly in the single valving movement. More particularly, the valve assembly includes a valve body having two levels of supply passages. The first level includes radial ports communicating with an internal bore and respectively connected to the oil supply line, the main burner oil supply line and the stand-by burner oil supply line. The second level includes radial ports communicating with the internal bore and respectively connected to the steam supply line, the main burner steam supply line and the stand-by burner steam supply line. A valve plug disposed in the bore includes first and second chordal channels formed at the two levels of passages. The plug is rotatable between two stop positions. In the first stop position, the channels connect the supplies with the main burner supply lines so as to valve fuel oil to the main burner. As the valve plug is rotated to the second stop position and at an intermediate position, the channels commonly connect the supply to both burner supply lines so as to commonly route oil to both the main burner and the stand-by burner. The steam channel spans a greater arcuate sector than the oil channel such that steam is supplied to the steam line in advance of the time fluid communication is established to the oil supply passages. This ensures that atomizing steam will be provided to the burner tip in advance of the oil supply.

When it is desired to replace or repair the main burner, the valve assembly is rotated to an intermediate position whereat steam and oil supply lines are connected to both burners. Once the stand-by burner is ignited, the valve motion is continued, shutting off the main oil and steam supply system and directly routing steam and oil to the stand-by burner. When the repair has been completed, the sequence is reversed and all fuels and flows are automatically handled in the proper reverse sequence.

The above and other features of the present invention will be apparent to one skilled in the art upon reading the following detailed description, reference being made to the accompanying drawings illustrating a preferred embodiment.

DESCRIPTION OF THE PREFERRED EMBODIMENT

Figure 1:
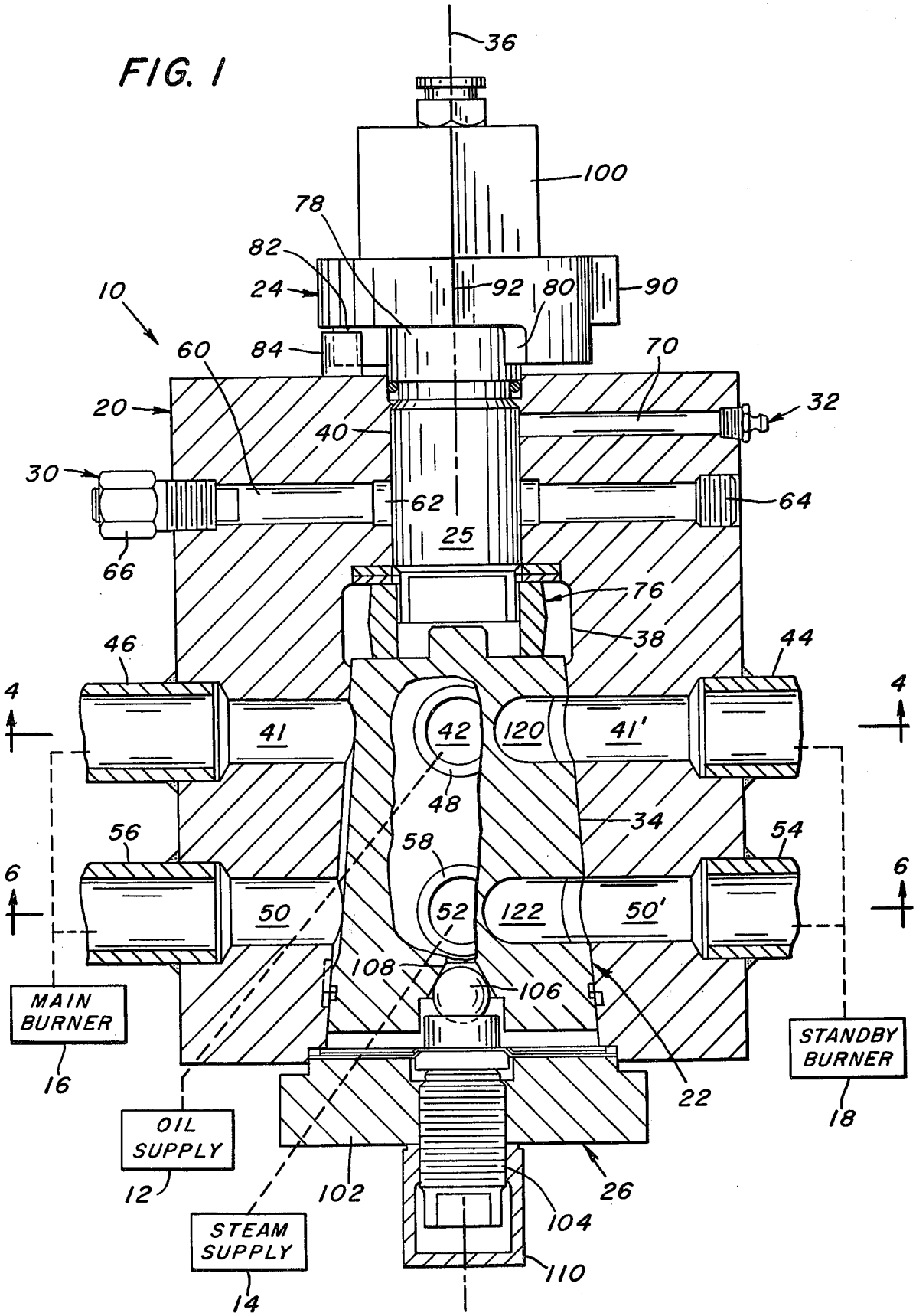
FIG. 1 is a side cross-sectional view of a burner block valve assembly made in accordance with the present invention, which assembly supplies oil and steam selectively to a main burner or a stand-by burner, the valve being shown in the main burner ignition position.

Referring to FIG. 1, there is shown a Y-jet burner block valve assembly 10 for use in a single burner industrial boiler installation. The valve assembly 10, as hereinafter described in detail, serves to commonly route oil from an oil supply 12 and steam from a steam supply 14 selectively to a main burner 16 or a stand-by burner 18. The valve assembly 10 functions to ensure uniform sequencing of oil and steam to the stand-by burner 18 when the same is used to carry the load when the main burner 16 is being repaired. The main burner 16 and stand-by burner 18 are of conventional design and are represented herein only by block diagram.

The burner block valve assembly 10 comprises a machined valve body 20, a valve plug 22, a cap and actuator assembly 24 including a stem 25 and a thrust plate assembly 26.

Figure 2:
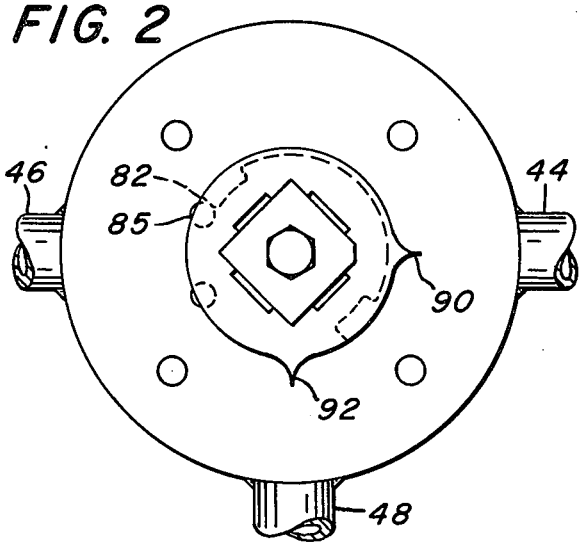
FIG. 2 is a top view of the valve assembly of FIG. 1, showing a valve plug cap in the main burner ignition position.
Figure 3:
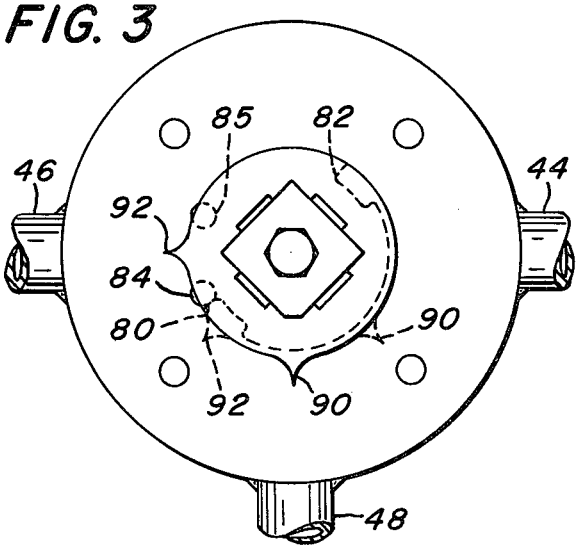
FIG. 3 is a view similar to FIG. 2, showing the valve plug cap in the stand-by burner ignition position with the joint burner ignition position being shown in dashed lines.
Figure 4:
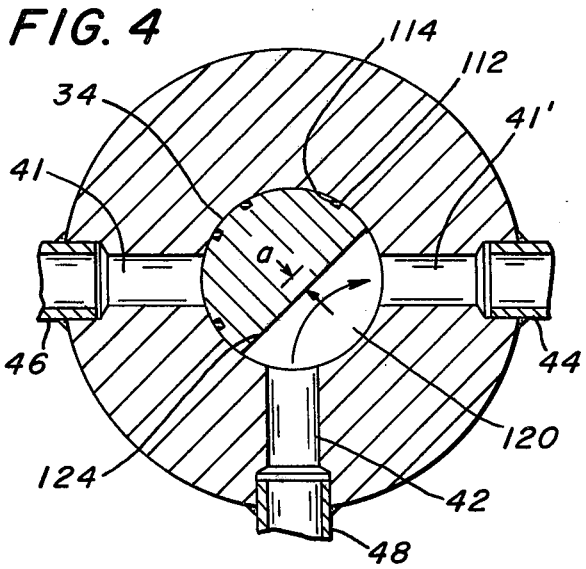
FIG. 4 is a view taken along lines 4—4 of FIG. 1, showing the oil supply channel in the valve plug routing oil from the oil supply line to the main burner oil supply line.
Figure 5:
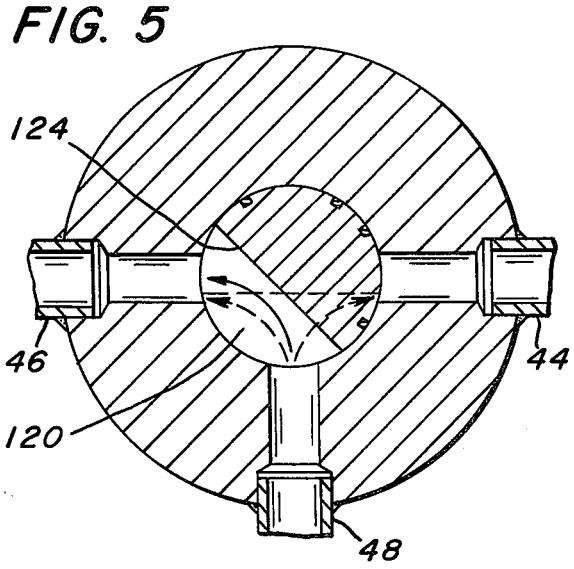
FIG. 5 is a view similar to FIG. 4, showing the oil supply channel in the valve plug routing oil from the oil supply line to the stand-by oil supply line and showing the joint routing to the burners in dashed lines.
Figure 6:
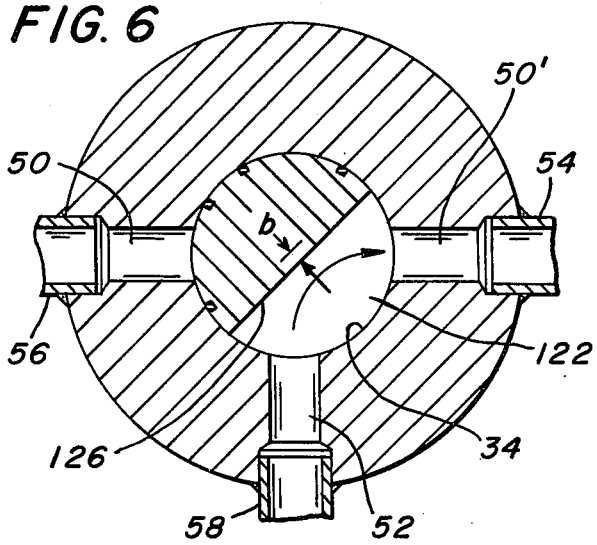
FIG. 6 is a view taken along lines 6—6 of FIG. 1, showing the steam supply channel in the valve plug routing steam from the steam supply line to the main burner steam supply line.

The valve body 20, as shown by joint reference to FIGS. 1 – 7, is generally a circular cylinder and is provided with a first lower level of passages connected to the steam supply 14 as generally indicated in FIG. 4 and a second upper level of passages as generally shown in FIG. 6. A sealer injection assembly 30 and a stem lubricant assembly 32 are provided at the upper end of the valve body 20. The valve body 20 further includes a lower frustoconical bore 34 formed coaxially with the valve assembly vertical axis 36 and an intermediate counter bore 38 terminating with an upwardly opening stem bore 40.

The lower level of passages comprises a diametral drilled passage communicating with the bore 34 and comprising branch passages 41 and 41'. A radial passage 42 perpendicularly intersects passages 41 - 41'. A stand-by burner supply pipe 44 is received in a counter bore in the valve body 20 adjacent the outer end of branch 41' and is fluidly connected to the stand-by burner 18 for delivering oil thereto in the manner described below. A main burner supply pipe 46 is received in a counter bore in the valve body 20 adjacent the outer end of branch passage 41 and is fluidly connected to the main burner 16. A supply pipe 48 is received in a counter bore adjacent the end of radial passage 42 and is fluidly connected to the oil supply 12.

The second level of passages includes a diametral drilled passage including branch passages 50 and 50' and a radial passage 52 perpendicularly intersecting the branch passages 50 and 50'. The passages 50, 50' and 52 commonly communicate with the bore 34. A stand-by steam supply pipe 54 is received in a counter bore adjacent to the outer end of branch passage 50' and is fluidly connected to the stand-by burner 18 for supplying steam thereto in the manner described below. A main steam supply pipe 56 is received in a counter bore in the valve body 20 adjacent the outer end of passage 50 and is fluidly connected to the main burner 16. A steam supply pipe 58 is received in a counter bore in the valve body 20 adjacent the outer end of the radial passage 52 and is fluidly connected to the steam supply 14.

The injector assembly 30 comprises a diametral passage 60 terminating adjacent the bore with an annulus 62. One end of the passage 60 is sealed by a plug 64. The other end of the passage includes an injector fitting 66. A suitable sealant retained in the passage 60 is increasingly compressed by adjustment of the assembly 66 to force sealant under pressure into the annulus 62 to effect a seal against the opposed surface of the stem 25.

A radial port 70 communicates with the bore 40 adjacent the upper end of the valve body 20 and is sealed by the grease fitting 32. Lubricant inserted through the fitting 32 serves to lubricate the outer surface of the stem 25.

The valve plug 22 is operably connected to the valve stem 25 at a keyed coupling connection 76 in the counter bore 38. The cap assembly 24 is fixedly connected to an outwardly projecting end 78 of the stem 25. The cap assembly 24 includes angularly spaced stop surfaces 80 and 82 which are adapted to alternately engage stop pins 84, 85 to establish rotative limits for the stem 25 and the coupled valve plug 22. The cap assembly 24 includes pointed projections 90 and 92 which are adapted to point toward the various supply pipes to indicate the position of the valve plug and the routing of the fluid. The cap assembly 24 includes a square head 100 adapted to be engaged by a suitable tool for rotating the valve between positions.

The thrust plate assembly 26 comprises a plate 102 secured by bolts (not shown) to the bottom surface of the valve body 20. The assembly 26 includes a thrust screw 104 which engages a spherical ball 106 retained in a frustoconical seat 108 in the bottom surface of the valve plug 22. By adjustment of the screw 104, the frustoconical valve plug is seated with varying force within the complementary shaped bore 34. The exposed end of the screw 104 is covered by a cap 110.

The valve plug 22 includes a plurality of circumferentially spaced axial grooves representatively indicated by the numeral 112. Sealing strips 114 are retained in the grooves 112. The sealing strips 114 seal against oil leakage between the non-communicating ports in the various positions.

Figure 7:
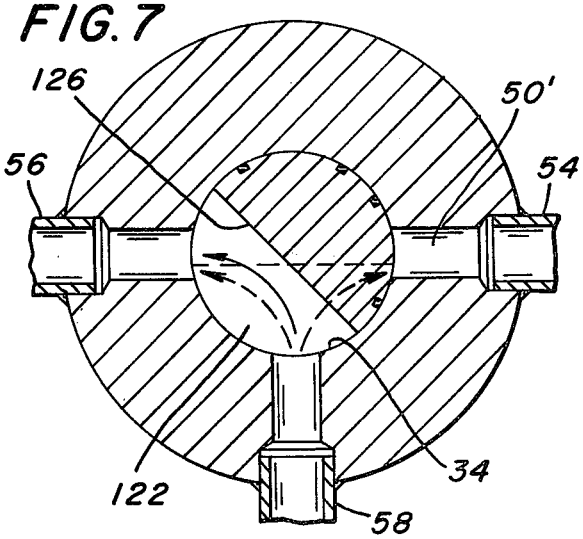
FIG. 7 is a view similar to FIG. 6, showing the steam supply channel in the valve plug routing steam from the steam supply line to the stand-by steam supply line and showing the joint routing to the burners in dashed lines.

The valve plug 22 is provided with two chordal slots for selectively interconnecting the various pipes, supplies and burners. More particularly, the valve plug as shown in FIGS. 4 and 5 is provided with a radially outwardly opening oil supply slot or channel 120 and a radially outwardly opening steam supply slot or channel 122 as shown in FIGS. 6 and 7. The channel 120 is axially aligned with the passages 41, 41' and 42 while the passage 122 is axially aligned with the passages 50, 50' and 52. The slot 120 includes a base surface 124 formed along a chord of the plug cross section and is spaced a first distance *a* from the axis of the plug. The slot 120 spans a sector of approximately 150°.

The slot 122 is formed in the side of the valve plug 22 at a distance *b* from the axis thereof. The distance *b* is less than the distance *a* of the slot 120 such that the slot 122 spans a greater sector than the slot 120. The sector is in the order of 160° – 170°.

As shown in FIGS. 2 and 3, the valve plug 22 is rotatable between a main burner ignition position shown in FIG. 2 to a stand-by burner position shown in FIG. 3 with an intermediate joint burner ignition position shown by the dashed lines in FIGS. 3, 5 and 7.

Referring to FIGS. 4 and 5, in the main burner ignition the slot 120 provides a flow path from the pipe 48 to pipe 44 so as to route oil from the oil supply 12 to the main burner 16. In the stand-by burner ignition position the slot 120 provides a flow path from pipe 48 to pipe 46 so as to route oil from the oil supply 12 to the stand-by burner 18. In the intermediate joint burner ignition position, base 124 is parallel to the axis of pipes 46, 44 and the latter pipes are limitedly connected with the supply pipe 48 so as to commonly route oil to both the main burner 16 and the stand-by burner 18.

As shown in FIGS. 6 and 7, in the main burner ignition position, the slot 122 provides a flow path from pipe 58 to pipe 54 so as to route steam from the steam supply 14 to the main burner 16. In the stand-by burner ignition position, the slot 122 provides a flow path from the pipe 58 to the pipe 56 so as to route steam from the steam supply 14 to the stand-by burner 18. In the intermediate joint burner ignition position, the base 124 is aligned parallel to the axes of the pipes 54 and 56 so as to limitedly connect the latter pipes with the pipe 58 and thereby commonly route the steam from the steam supply 14 to the stand-by burner 18 and the main burner 16.

In operation, when it is desired to replace or repair a worn main burner, the stand-by burner is connected to the pipes 44 and 54 and inserted into the ignition chamber. The valve is then slowly moved from the FIG. 2 position to the joint burner ignition position. Because the slot 122 spans a wider sector than the slot 120, steam is provided to passage 56 in advance of the supply of oil to pipe 46. This provides atomizing steam to the stand-by burner in advance of the supply of oil and assures complete atomization of the latter and proper ignition of the burner. When both burners are lighted, the valve movement is continued to the stand-by burner ignition position. This interrupts the supply of steam and oil to the main burner so as to extinguish the latter while maintaining ignition of the stand-by burner. The stand-by burner is fully connected to both supplies in the stand-by burner ignition position of the valve assembly 10.

When the main burner has been repaired or replaced, the reverse procedure is initiated wherein the main burner is reinserted in the ignition chamber, the valve moved to the intermediate position so as to ignite the main burner and thereafter moved to the main burner ignition position, rendering the main burner fully operative and extinguishing the stand-by burner which then may be withdrawn for future use.

Thus, in a single valve assembly, a programmed unidirectional valving sequence is provided which affirmatively sequences in proper order the routing of fuel and steam to separate burners so as to facilitate repair and replacement of the main burner. However, it should also be noted that the subject valve assembly also affords the same advantages when applied to any selective supply systems.

Although only one form of this invention has been shown and described, other forms will be readily apparent to those skilled in the art. Therefore, it is not intended to limit the scope of this invention by the embodiment selected for the purpose of this disclosure but only by the claims which follow.

I claim:

1. In a single tip burner wherein the tip is in continuous operation except for servicing or repairing during which time a stand-by burner tip is used to carry the load, a burner block valve assembly providing a single unit control for routing oil and steam selectively to said main burner or said stand-by burner, comprising: a valve body; a bore axially formed in the body; a circular valve plug disposed in the bore, said plug being rotatable about the axis of the bore successively between a main burner ignition position, a joint burner ignition position and a stand-by burner position; a first pair of angularly spaced outlets in the valve body communicating with the bore and adapted to be respectively connected to a main burner oil line and a stand-by burner oil line; a first inlet in the valve body communicating with the bore and spaced between the first pair of outlets, said first inlet adapted to be connected to the oil supply; a second pair of angularly spaced outlets formed in the valve body in axially spaced relationship to the first pair of outlets, said second pair of outlets communicating with the bore and adapted to be respectively connected to a main steam line and a stand-by steam line; a second inlet in the valve body communicating with the bore and spaced between the second pair of outlets, said second inlet adapted to be connected to the steam supply; a first radial slot formed in the side of the valve plug, the inner surface of said first radial slot being spaced a first distance from the axis and providing fluid communication in said main burner ignition position between the oil supply on the main burner oil line while blocking the stand-by oil line, in said joint burner ignition position providing fluid communication between the stand-by burner oil line commonly with the main burner oil line and with said oil supply, and in the stand-by burner ignition position blocking said main burner oil line and directly fluidly connecting said oil supply and said stand-by burner oil line with oil being uninterruptedly supplied to the first radial slot through the oil inlet during movement of the plug between positions; a second radial slot formed in the side of said valve plug in spaced relationship to the first radial slot, the inner surface of said second radial slot being spaced closer to the axis than said first radial slot and providing in said main burner ignition position fluid communication between said steam supply and said main burner steam line while blocking said stand-by burner steam line, in said joint burner ignition position providing fluid communication between the steam supply commonly with said stand-by burner steam line and said main burner steam line, and in said stand-by burner ignition position blocking said main burner steam line and directly fluidly connecting said steam supply to said stand-by burner steam line with steam being uninterruptedly supplied to the second radial slot through the steam inlet during movement of the plug between positions.

2. The burner block valve assembly recited in claim 1 wherein said pairs of outlets are diametrically opposed.

3. The burner block valve assembly recited in claim 2 wherein said inlets are angularly spaced substantially midway between said outlets.

4. The burner block valve assembly recited in claim 1 wherein said first radial slot spans a sector of approximately 150° and said second radial slot spans a sector in the order of 160° to 170°.

* * * * *